US006389985B1

(12) United States Patent
Trent

(10) Patent No.: US 6,389,985 B1
(45) Date of Patent: May 21, 2002

(54) COMPOSITE BOSS BLOCK FOR RAIL CAR TRUCK

(75) Inventor: Robert S. Trent, Crown Point, IN (US)

(73) Assignee: Holland Company, Crete, IL (US)

( * ) Notice: Subject to any disclaimer, the term of this patent is extended or adjusted under 35 U.S.C. 154(b) by 0 days.

(21) Appl. No.: 09/785,887

(22) Filed: Feb. 16, 2001

(51) Int. Cl.[7] ..... B61F 3/00
(52) U.S. Cl. ..... 105/195; 105/182.1; 105/196
(58) Field of Search ..... 105/157.1, 165, 105/166, 167, 179, 182.1, 183, 194, 195, 199.3, 199.4, 209, 225

(56) References Cited

U.S. PATENT DOCUMENTS

| | | | | |
|---|---|---|---|---|
| 4,155,507 | A | 5/1979 | Chierici et al. | 237/287 |
| 4,188,888 | A | 2/1980 | Cooper et al. | 105/199 C |
| 4,294,712 | A | 10/1981 | Ueno et al. | 252/12 |
| 4,344,541 | A | 8/1982 | Chierici | 213/61 |
| 4,357,249 | A | 11/1982 | Mellor | 252/12 |
| 4,463,835 | A | 8/1984 | Murphy et al. | 188/52 |
| 4,463,836 | A | 8/1984 | Murphy et al. | 188/52 |
| 4,471,857 | A | 9/1984 | Murphy | 188/52 |
| 4,474,267 | A | 10/1984 | Empson | 188/33 |
| 4,567,833 | A | 2/1986 | Hanson | 105/199 CB |
| 4,574,708 | A | 3/1986 | Solomon | 105/193 |
| 4,781,124 | A | 11/1988 | List | 105/168 |
| 4,955,144 | A | 9/1990 | Lienard et al. | 105/4.2 |
| 4,986,192 | A | 1/1991 | Wiebe | 105/198.4 |
| 5,086,708 | A | 2/1992 | McKeown, Jr. et al. | 105/207 |
| 5,097,973 | A | 3/1992 | Spencer | 213/50 |
| 5,133,467 | A | 7/1992 | Hawthorne et al. | 213/59 |
| 5,159,881 | A | 11/1992 | Durand et al. | 105/199.2 |
| 5,746,135 | A | 5/1998 | Ahmadian et al. | 105/196 |
| 5,924,366 | A | 7/1999 | Trainer et al. | 105/206.1 |
| 5,947,031 | A | 9/1999 | Polley | 105/453 |
| 5,992,330 | A | 11/1999 | Gilbert et al. | 105/200 |

OTHER PUBLICATIONS

Ultracomp—Family of Bearing Grade Composites, Tri–Star Plastics Corp., copyright 1999–2001.*

*1997 Car & Locomotive Cyclopedia*, pp. 727–728.

Tri–Star Plastics Corp., Internet Web Site, Ultra*comp and Ultra*comp UC–200, Composite Bearing Materials (no date).

* cited by examiner

*Primary Examiner*—Mark T. Le
(74) *Attorney, Agent, or Firm*—Lee, Mann, Smith, McWilliams, Sweeney & Ohlson

(57) ABSTRACT

A set of composite boss blocks for a rail car truck having equalizer arms and side frames uses a thermoset plastic resin system with a synthetic fiber reinforcement contained within the plastic matrix to handle severe loads under impact and vibration, in combination with set screw or pin extending through the mounting portion and well into the body of the boss block, a complementary wear pad also being usable.

12 Claims, 4 Drawing Sheets

COMPOSITE BOSS BLOCK FOR RAIL CAR TRUCK

BACKGROUND OF THE INVENTION

1. Field of the Invention

High capacity freight cars such as well car, depressed center, and straight flat cars, large tank cars and other types for transporting heavy special equipment, use trucks of suitable carrying capacity often arranged for equalized design. Typical trucks, include Buckeye Elasto-Cushion six wheel (three axle) trucks and use a combination of side frames and equalizer arms that extend from the location of the central axle. The equalizer arms and side frame portions bear on cast steel boss blocks having male and female sets mounted on the side frames and equalizer arms. The invention uses a combination of features to achieve a composite boss block set having improved performance and service life.

2. Description of Related Art

The existing steel boss blocks cause wear on the side frames and equalizers as well as wearing themselves. Other plastic wear parts performing functions of original equipment steel rail car parts are known, such as coupler carrier wear plates, (U.S. Pat. No. 4,344,541 entitled "Coupler carrier arrangement for railroad cars") center bearing liners (U.S. Pat. No. 4,075,951 entitled "Self lubricating center bearing liner") and brake beam guides (U.S. Pat. No. 4,480,721 entitled "Snap-on slide bearing for recessed type guide lugs of unit brake beams."). These are cited as examples of the use of plastics, but do not contain the teachings of this specification for high load, mechanically fastened boss blocks. Their disclosures, however, are incorporated by reference as if fully set forth herein.

The AAR Manual of Standard and Recommended Practices Section D, Truck and Truck Details 8-300-95 at Page D-3, No. 23 covers these components and is incorporated by reference as if fully set forth herein.

SUMMARY OF THE INVENTION

The composite boss blocks of the invention may be made advantageously with a composite material that will prevent wear on faying surfaces as well as wear on themselves. The periodic build-up of contaminants and worn material and the need for replacement of the truck components causes mechanical inefficiency in the operation of the equipment and therefore a solution to this problem will prove very beneficial to the owners of cars using the three axle trucks.

The boss blocks of the invention are made from a new advanced bearing grade composite material sold under the trademark UltraComp. This material combines a proprietary thermoset plastic resin system with a synthetic fiber contained within the plastic matrix and is able to handle severe loads under impact and vibration. UltraComp remains self-lubricating throughout its bearing life. UltraComp is available from Tri-Star Plastics Corp. of 906 Boston Turnpike Shrewsbury Mass. 01545. A complementary wear pad can be used with, or in lieu of the composite boss block sets themselves.

The composite parts, formed and arranged as taught herein, and using the materials described, will reduce wear on interfacing surfaces of the truck at the location of the boss blocks. Relevant material properties of the preferred fiber reinforced resin are: Compressive Strength: 54,000 psi.; Coefficient of Friction on Steel:0.16, and Continuous Service Temperature: 260° F.

The static vertical load on each composite boss block pair is about 50,000 lbs. producing a pressure of about 2,941 psi. Using a vertical dynamic load of 2 g., this provides a factor of safety of 8.5.

Related to the composite boss blocks is an approach using the same materials in a different configuration.

DETAILED DESCRIPTION OF THE PREFERRED EMBODIMENTS

Figure 12:
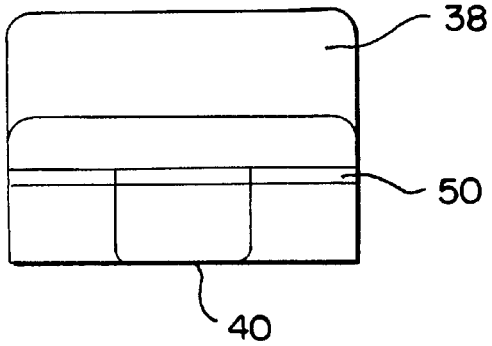
FIG. 12 is an end elevation showing a boss block wear pad in place with a boss block on a truck casting.
Figure 13:
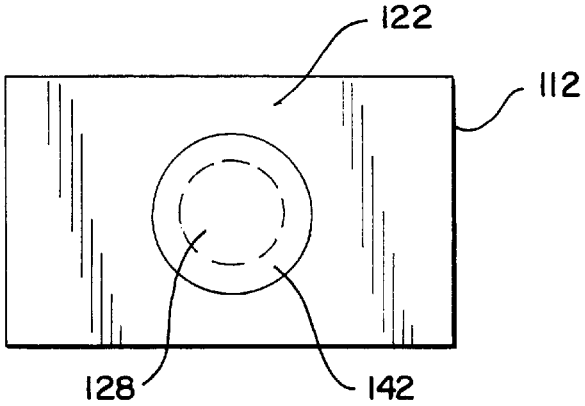
FIG. 13 is top plan view of the female boss block of the press fit pin embodiment.
Figure 15:
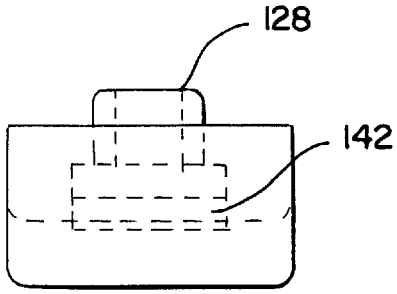
FIG. 15 is an end elevational view of the female boss block of the press fit pin embodiment.
Figure 14:
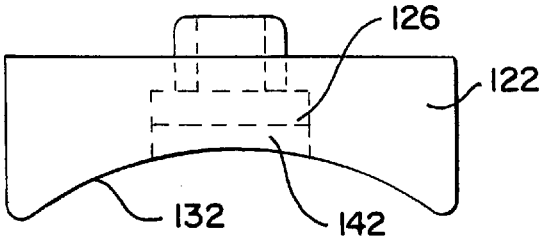
FIG. 14 is a side elevational view of the female boss block of the press fit pin embodiment.
Figure 16:
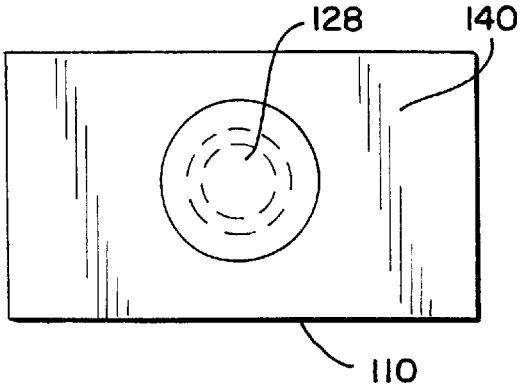
FIG. 16 is a side elevational view of the male boss block of the press fit pin embodiment.
Figure 17:
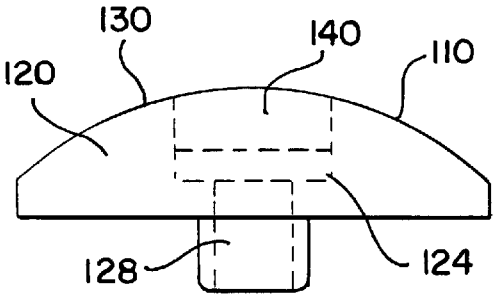
FIG. 17 is top plan view of the male boss block of the press fit pin embodiment.
Figure 18:
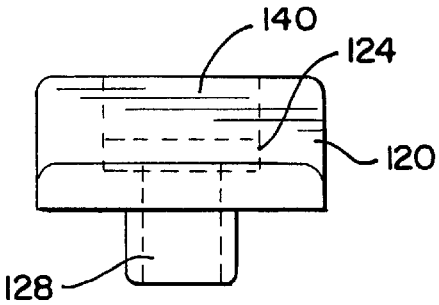
FIG. 18 is an end elevational view of the male boss block of the press fit pin embodiment.

The male 10 and female 12 boss blocks as shown in the drawings, and described herein, are components in the Buckeye Elasto-Cushion six-wheel (three axle) truck 14. These components (one male 10 and one female 12) comprise a set 16, and are located at each of four locations 18 per truck—two locations 18 on each side—between the equalizer arms 20 and side frame assembly 22. These components function together to provide a connection of the equalizer arms 20 and side frame assembly 22 in a manner which provides for vertical flexibility of the truck 14 to allow negotiation of vertical curves. The convex surface 30 of the male block 10 slides relative to the concave surface 32 of the female block 12 when an angle is produced between the two side frame halves 34, 36. The original equipment boss blocks 38 are steel castings that experience rapid and costly wear in service on all interfacing surfaces. It will be understood that the steel boss block 38 illustrated in FIG. 12 is to emphasize the wear pad 50. However, wear pads could also complement all-composite boss block sets, especially when wear on the side frame and equalizer have occurred as a result of the steel-on-steel contact of the prior art boss blocks 38.

The design of the boss blocks 10, 12 of one embodiment of the invention incorporate a 1 in. diameter set screw 40 that provides additional shear strength to the retention feature of the parts. These screws 40 are rated such that it will require a shear load in excess of 40,000 lbs. to shear them off. That value is greater than that of the UltraComp material. Thus, should the boss assembly 42 see high shear forces one can expect some deformation of the composite material 44 before other failure modes occur. An improved embodiment uses a pin, as more fully described below, which maintains the pin in position should the composite material deform or work under load.

Figure 1:
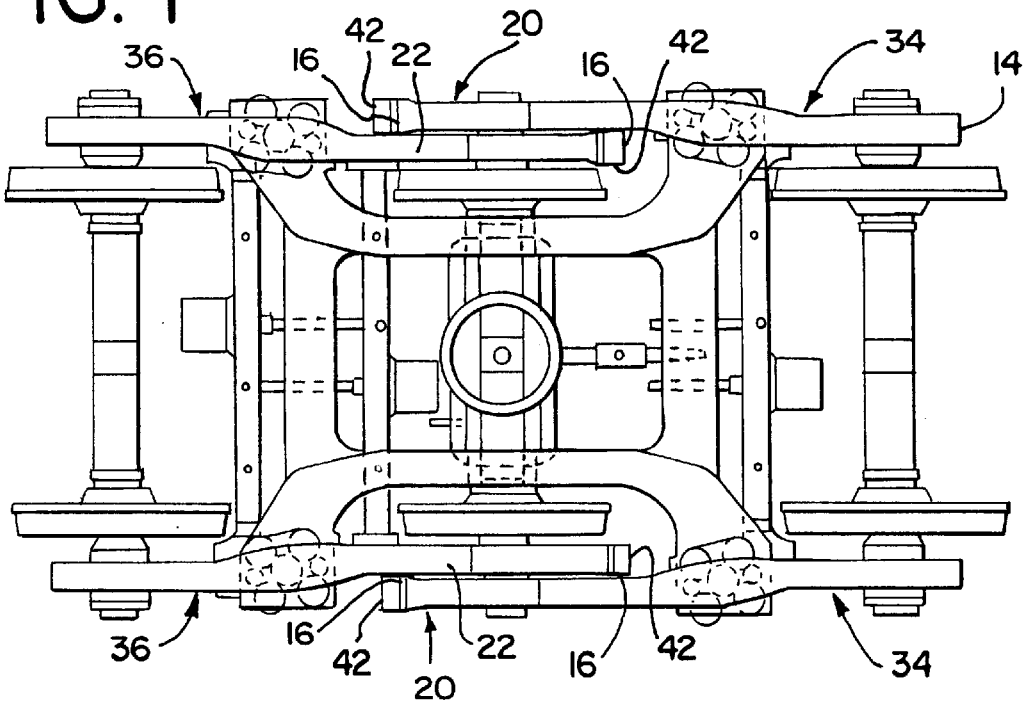
FIG. 1 is a top plan view of a six-wheel (three axle) truck.
Figure 2:
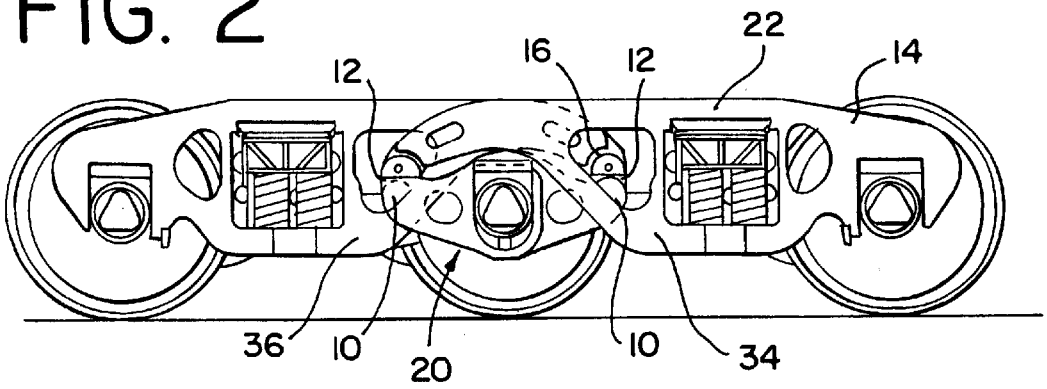
FIG. 2 is a side elevational view of a six-wheel (three axle) truck.
Figure 3:
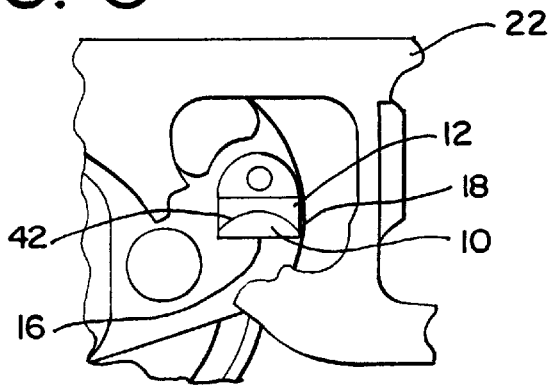
FIG. 3 is a fragmentary elevational view of a typical boss block arrangement for a sixwheel (three axle) truck.
Figure 4:
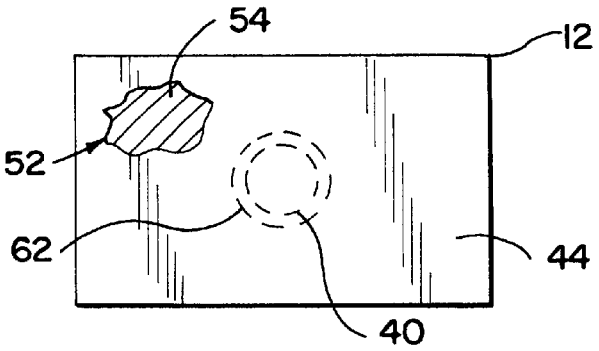
FIG. 4 is top plan view of the female boss block.
Figure 6:
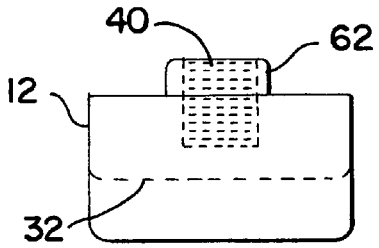
FIG. 6 is an end elevational view of the female boss block.
Figure 5:
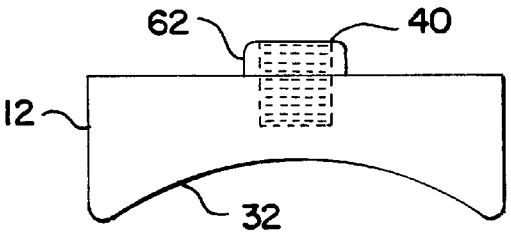
FIG. 5 is a side elevational view of the female boss block.
Figure 7:
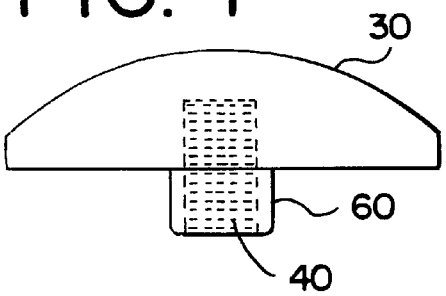
FIG. 7 is a side elevational view of the male boss block.
Figure 8:
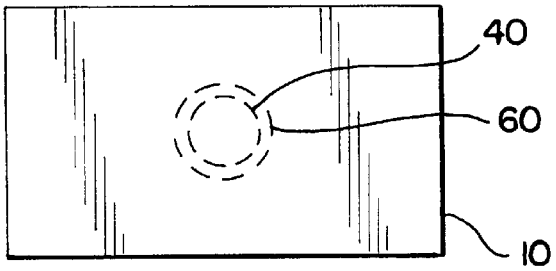
FIG. 8 is top plan view of the male boss block.
Figure 9:
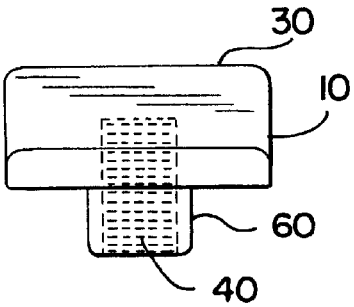
FIG. 9 is an end elevational view of the male boss block.
Figure 10:
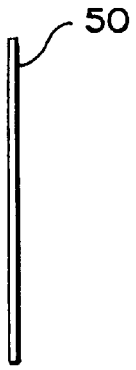
FIG. 10 is an end elevation showing a boss block wear pad.
Figure 11:
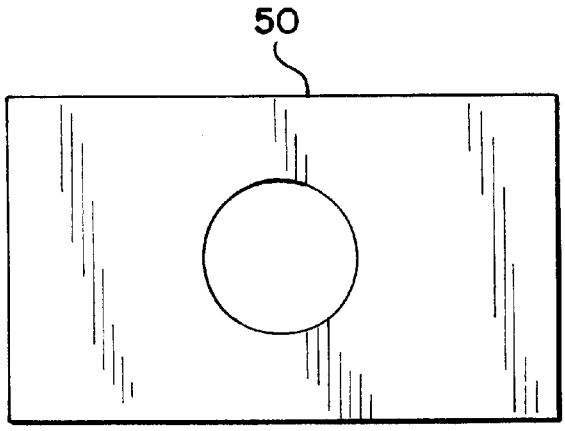
FIG. 11 is a top plan view showing a boss block wear pad.

A complementary wear pad 50 can also be used advantageously. As shown in FIGS. 10–12, where an original equipment boss block 38 is used, or as an adjunct to the Ultra Comp formed material boss blocks 10, 12 such as for additional protection, as shims or the like. It will be noted that a serious drawback to the original equipment steel boss blocks 38 is that they not only wear the opposed boss blocks, but the base portions of the steel boss blocks 38 cause wear on the equalizer 20 and side frame 22 sections of the truck 14. Thus, it has been discovered, instead of merely being a replaceable wear part, in fact the wear part itself causes wear on the parts it should be protecting. Accordingly, spacing wear pads 50 as shown in FIGS. 10–12 can serve to isolate the equalizer 20 and side frame 22 sections from the steel boss blocks 38. As described above, wear pads 50 may also be used with the composite boss blocks 10, 12.

The UltraComp material of the boss blocks and spacing wear pads has already proven itself in North American freight car applications such as hydraulic cushioning device guide rings and hand brake sleeve bearings. These applications have been in service for about four years with zero replacement and no significant wear. UltraComp is also being used as coupler pivot bearings in heavy rail transit.

The composite material 44 combines a thermoset plastic resin portion 52 with a thermoplastic synthetic fiber reinforcement 54. In various rail car parts, numerous plastics with a variety of reinforcements have been attempted.

In operation boss block 10 and 12 each have a projecting cylindrical portion 60, 62 projecting from the side opposite their respective surfaces 30, 32. Set screws 40 are threaded into the cylindrical portions 60, 62 to provide reinforcement against shear loads. Cylindrical portions mate with corresponding recesses in the side frames, as is know to one of ordinary skill as original equipment steel boss blocks 38 are installed in that manner.

During testing of the original set screw embodiment it has been determined that an alternative embodiment can provide improved durability and performance. In the improved embodiment, boss block 110 and boss block 112 have body portions 120, 122 formed in a counterbored shape to provide recesses 124, 126 to receive headed pins 128. In order to maintain bearing surfaces 130, 132, corresponding plugs 140, 142 are press fit in place. Thus, unlike the set screw 40, that may be inserted into a threaded recess formed in the boss block, from the side opposite the surface, and relying on the threads to maintain it in position as the boss block material works, flexes or creeps under load, the headed pin 128 fits from the surface side. Thus the headed pin does not work free from the boss block 110, 112 in use as the plastic material works under load. Like the set screw, pings 128 are rated such that it will require a shear load in excess of 40,000 lbs. to shear them off. That value is greater than that of the UltraComp material. Thus, should the boss block 110, 112 have high shear forces imposed, deformation of the composite material will not diminish overall shear strength.

While the present invention has been disclosed and described with reference to a single embodiment thereof, it will be apparent, as noted above that variations and modifications may be made therein. It is also noted that the present invention is independent of the particular brand of rail car trucks being used, and is not limited to the a particular manufacturer's trucks. It is, thus, intended in the following claims to cover each variation and modification that falls within the true spirit and scope of the present invention.

I claim:

1. A set of wear resistant boss blocks for equalized trucks capable of handling severe loads under impact and vibration on high capacity freight cars, in which the trucks use a combination of side frames and equalizer arms that extend from a central axle comprising:

a male set of boss blocks and a female set of boss blocks in which said sets of boss blocks are formed of a composite self-lubricating reinforced plastic material having improved performance and service life, including a set screw reinforcing said male and female blocks to provide additional shear strength.

2. A set of wear resistant boss blocks for equalized trucks capable of handling severe loads under impact and vibration on high capacity freight cars, in which the trucks use a combination of side frames and equalizer arms that extend from a central axle comprising:

a male set of boss blocks and a female set of boss blocks in which said sets of boss blocks are formed of a composite self-lubricating reinforced plastic material having improved performance and service life.

wherein the plastic material is a thermoset resin having a compressive strength of about 54,000 psi, a coefficient of friction on steel of about 0.16 and a continuous service temperature of about 260° F. said plastic material including plurality of reinforcing woven fibers within the plastic matrix;

said blocks including a set screw of about one inch diameter reinforcing said male and female blocks to provide additional shear strength.

3. The boss blocks of claim 2 including a complementary spacing wear pad between said male and female blocks, said pad comprising a thermoset polyester resin with a woven polyester thermoplastic fiber reinforcement.

4. A boss block for equalized trucks capable of handling severe loads under impact and vibration on high capacity freight cars, in which the trucks use a combination of side frames and equalizer arms that extend from a central axle comprising:

said boss block being one of a set of either a male boss block and a female boss blocks adapted for use as a set in which said set of boss blocks are formed of a composite self-lubricating reinforced plastic material having improved performance and service life;

said boss block having a body and a reinforcing member whereby improved shear strength is provided by said reinforcing member when it is received in said body; said boss block being formed to receive said reinforcing member;

said boss block being formed to have a bearing surface whereby said boss block is adapted to matingly contact its corresponding other boss block in said set;

said boss block body being adapted to maintain said surface after receipt of said reinforcing member, said boss block further comprising:

said reinforcing member being a set screw threaded into said boss block body.

5. A boss block for equalized trucks capable of handling severe loads under impact and vibration on high capacity freight cars, in which the trucks use a combination of side frames and equalizer arms that extend from a central axle comprising:

said boss block being one of a set of either male boss blocks and female boss blocks adapted for use as a set in which said set of boss blocks are formed of a composite self-lubricating reinforced plastic material having improved performance and service life;

said boss block having a body and a reinforcing member whereby improved shear strength is provided by said reinforcing member when it is received in said body; said boss block being formed to receive said reinforcing member:

said boss block being formed to have a bearing surface whereby said boss block is adapted to matingly its corresponding other boss block in said set; said boss block body being adapted to maintain said surface after receipt of said reinforcing member, said boss block further comprising:

said reinforcing member being a headed pin press fit in a counterbored recess formed in said body.

6. The boss block of claim 5 further comprising:

said surface being maintained by insertion of a plug of a form corresponding to the desired surface shape.

7. The boss block of claim 5 further comprising:

said boss block being one of a set of male and female boss blocks.

8. The boss block of claim 5 further comprising:

said boss block being adapted to receive a boss block wear pad.

9. The boss block of claim 5 wherein the wear pad is made of a thermoset plastic resin having a compressive strength of about 54.000 psi, a coefficient of friction on steel of about 0.16 and a continuous service temperature of about 260° F.

10. A set of wear resistant boss blocks for equalized trucks capable of handling severe loads under impact and vibration on high capacity freight cars, in which the trucks use a combination of side frames and equalizer arms that extend from a central axle comprising:

a male set of boss blocks and a female set of boss blocks in which said sets of boss blocks are formed of a composite self-lubricating reinforced plastic material having improved performance and service life, including a pin reinforcing said male and female blocks to provide additional shear strength.

11. The boss blocks of claim 10 including a complementary spacing wear pad between said male and female blocks, said pad comprising a thermoset polyester resin with a woven polyester thermoplastic fiber reinforcement.

12. The boss blocks of claim 10 and said pin is a steel pin of about 1" diameter.

* * * * *